US006506126B1

(12) United States Patent
Goodman

(10) Patent No.: US 6,506,126 B1
(45) Date of Patent: Jan. 14, 2003

(54) ADJUSTABLE GOLF CLUB

(76) Inventor: Phillip M. Goodman, 3129 W. Pierre Ct., Mequon, WI (US) 53092

( * ) Notice: Subject to any disclaimer, the term of this patent is extended or adjusted under 35 U.S.C. 154(b) by 0 days.

(21) Appl. No.: 09/900,099

(22) Filed: Jul. 6, 2001

(51) Int. Cl.[7] ..... A63B 53/06
(52) U.S. Cl. ..... 473/245; 473/247
(58) Field of Search ..... 473/245, 246, 473/247, 248, 325, 288; 403/97

(56) References Cited

U.S. PATENT DOCUMENTS

| | | | | |
|---|---|---|---|---|
| 2,477,438 | A | * | 7/1949 | Brouwer |
| 2,882,053 | A | * | 4/1959 | Lorthiois |
| 3,791,647 | A | | 2/1974 | Verderbar |
| 3,840,231 | A | * | 10/1974 | Moore |
| 5,083,779 | A | * | 1/1992 | Ungermann |
| 5,133,553 | A | * | 7/1992 | Divnick |
| 5,413,337 | A | | 5/1995 | Goodman et al. |
| 5,538,245 | A | * | 7/1996 | Moore |

FOREIGN PATENT DOCUMENTS

| | | | | |
|---|---|---|---|---|
| GB | 0116 | * | 4/1892 | 273/79 |
| GB | 23578 | * | 11/1901 | 273/79 |
| GB | 23839 | * | 12/1914 | 273/79 |
| GB | 214466 | * | 4/1924 | 273/79 |

* cited by examiner

*Primary Examiner*—Sebastiano Passaniti
(74) *Attorney, Agent, or Firm*—Andrus, Sceales, Starke & Sawall, LLP

(57) ABSTRACT

A golf club includes a shaft, a hosel mounted on the lower end of the shaft and a golf club head mounted on the hosel for pivotal movement about an axis which is generally horizontal when the club is in an addressed position. The golf club head includes a blade portion pivotally mounted to a heel portion. A lever is operably connected to a linkage assembly so that the lever can be moved from a first position in which the linkage assembly secures the blade to the heel and a second position in which the linkage assembly allows disengagement of the blade from the heel so that the blade may be rotated relative to the heel.

4 Claims, 4 Drawing Sheets

ADJUSTABLE GOLF CLUB

FIELD OF THE INVENTION

This invention relates to golf clubs and more specifically to adjustable golf clubs in which the loft of the club face may be varied.

BACKGROUND OF THE INVENTION

This invention relates to golf clubs and more particularly to golf clubs having an adjustable head.

A full set of golf clubs normally includes between eight and eleven iron clubs, two or more woods and a putter. The iron clubs are numbered 1–9 and in addition there may be a number of wedges of varying lofts. The loft angle of the clubs, that is the angle between the club face and the vertical when the player is addressing the ball, increases in increments of about three to four degrees from the one iron up through the nine iron and the wedges. This causes the trajectory of the ball to increase in height and decrease in distance as more lofted clubs are used so that the player may hit shots of varying length with substantially the same swing.

In order to reduce the number and hence the weight of the clubs required to provide the full range of loft angles, adjustable clubs have been developed. Two such prior art clubs are disclosed in U.S. Pat. Nos. 3,840,231 and 3,791,647. These prior art adjustable golf clubs generally include a single iron head which may be adjusted from relatively small to a relatively large loft angle. The various angles are established by meshing teeth on the club head and shaft end. This requires that the club head be disengaged from the shaft to change the loft angles and then the two must be reengaged. As a result, changing the loft angle on such prior art clubs was cumbersome and in some cases required the use of a tool. One prior art adjustable golf club that addresses these problems is shown in my U.S. Pat. No. 5,413,337. However, even this adjustable club utilized multiple parts making it more expensive and difficult to manufacture. The numerous parts and their location also added to the weight and appearance of the club so that it did not have the look and feel of a conventional golf club.

BRIEF SUMMARY OF THE INVENTION

It is an object of the invention to provide a new and improved adjustable golf club.

A further object of the invention is to provide an adjustable golf club in which the loft angle of the head can be conveniently adjusted with a minimum of effort and without tools.

To this end, the adjustable golf club of the invention utilizes a golf club having normal address position when the user addresses the club. The golf club includes a shaft, a club head mounted on the lower end of the shaft with the club head including a hosel, a heel portion and a blade portion.

In accordance with one aspect of the invention, the blade portion is connected to the heel portion for limited pivotal movement about an axis which is generally horizontal when the club is in the addressed position.

In accordance with yet another aspect of the invention, the golf club is provided with latching means that utilizes a lever pivotally mounted on the heel and movable between a first position in which the lever is substantially parallel to the shaft and in which the heel portion and blade portion are rigidly coupled and a second position in which the lever is rotated away from the shaft and in which the blade portion is disengaged from the hosel portion allowing limited rotational movement of the blade relative to the heel.

In accordance with yet another aspect of the invention, the golf club is provided with a linkage mechanism that utilizes a stud disposed within a cavity of the heel portion and extend horizontally from the heel portion into a cavity in the back of the blade portion.

In accordance with still yet another aspect of the invention, a pin is operably connected to the lever and stud and movable in cooperation with the lever from a first position in which the heel portion and blade portion are rigidly coupled and a second position in which the blade portion is disengaged from the heel portion to allow limited rotational movement of the blade relative to the heel.

In accordance with still another aspect of the invention, the golf club is provided with a biasing means disposed within the cavity in the heel portion to urge disengagement of the blade portion from the heel portion.

These and other objects and advantages of the present invention will become more apparent from the detailed description thereof taken with the accompanying drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
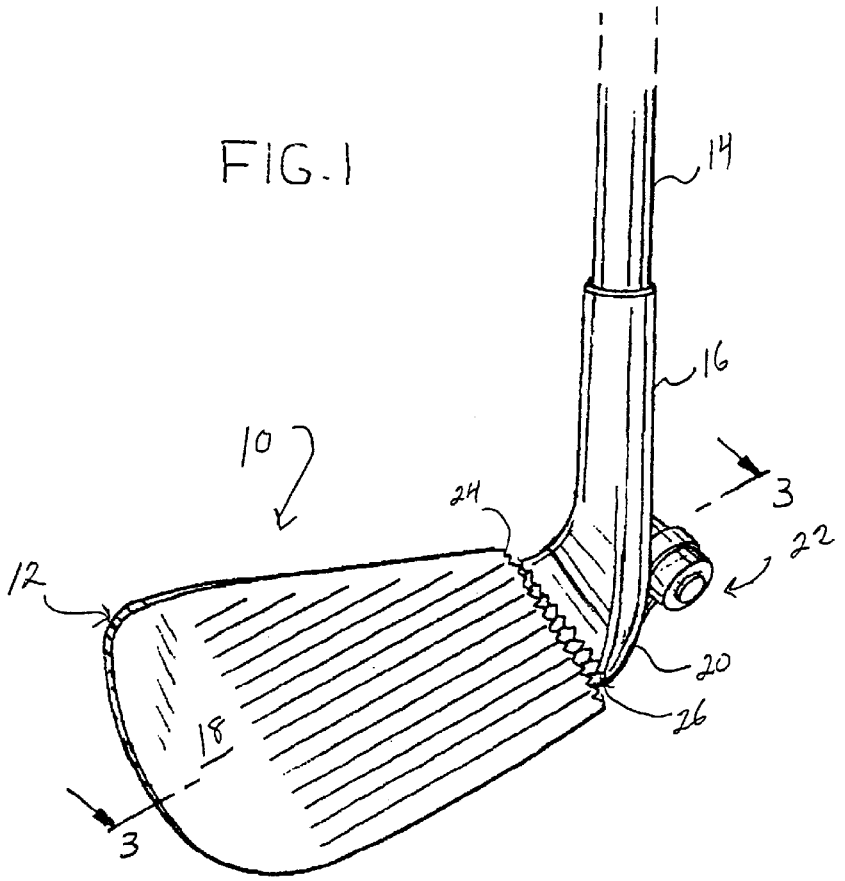
FIG. 1 is a perspective view of a golf club incorporating an adjustable head according to the present invention.

As shown in FIG. 1, a golf club 10 includes a head 12 and a shaft 14. Head 12 includes a hosel 16 which is telescopically received in the lower end of shaft 14. Head 12 includes a blade 18 and a heel 20. Heel 20 is formed integrally with hosel 16 and blade 18 is mounted on heel 20 for limited pivotal movement.

A loft angle adjustment assembly 22 couples blade 18 to heel 20 for adjusting the loft angle X which is the angle between the face of blade 18 and the vertical when the player is addressing the ball at the address position. The upper end of hosel 16 is generally tubular and may be formed of any suitable material used for forming golf club heads such as stainless steel.

In conventional golf clubs, the hosel 16, the blade 18 and the heel 20 are integrally formed. In the golf club of the present invention, the blade 18 and the heel 20 are separated along a generally vertical plane to define mating edges 24 and 26. Edges 24 and 26 are provided with mating gear teeth to maintain the loft angle of blade 18 when blade 18 and heel 20 are securely engaged.

Figure 2A:
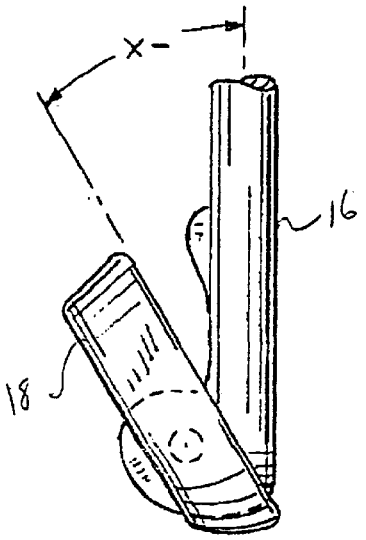
FIG. 2A is an end view of the golf club of FIG. 1 with the head of the club rotated to a less lofted position.
Figure 2B:
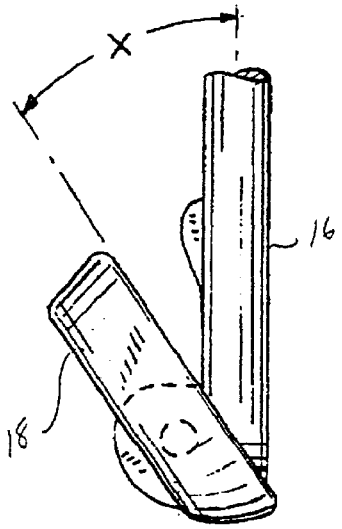
FIG. 2B is an end view of the golf club of FIG. 1 with the head of the club in a standard position.
Figure 2C:
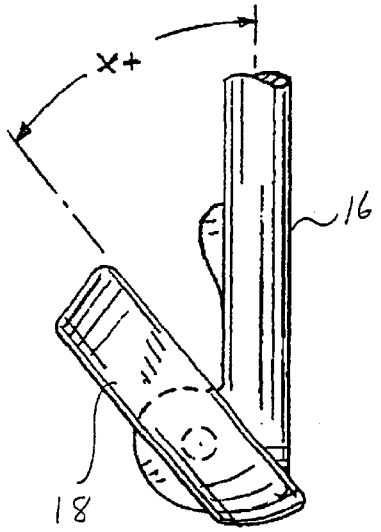
FIG. 2C is an end view of the golf club of FIG. 1 with the head of the club rotated to a more lofted position.

As shown in FIGS. 2A through 2C, loft angle adjustment assembly 22 allows the loft of blade 18 to be moved from a standard loft X to a less lofted position X– or a more lofted position X+. Typically, the loft is increased or decreased in 4° increments.

As shown in FIGS. 3–5 and FIG. 7, the loft angle adjustment assembly 22 is provided with a latching means in the form of lever 28 that is movable between a first position in which lever 28 is substantially parallel to the shaft 14 and in which the heel portion 20 and the blade portion 18 are rigidly coupled and a second position in which lever 28 is rotated away from shaft 14 (FIG. 4) and blade portion 18 is disengaged from heel portion 20 to allow limited rotational movement of blade 18 relative to heel 20.

Adjustment assembly 20 further includes a linkage assembly 30 that includes lever stud 32 that is disposed within cavity 34 of heel portion 20. Lever stud 32 is held within cavity 34 by means of adjustment pin 36. Adjustment pin 36 also operably connects lever 28 to lever stud 32 by extending through openings 38 and 40 in lever stud 32 and lever 28, respectively. A substantially rectangular portion 42 on adjustment pin 36 mates with opening 40 so that rotation of lever 38 will cause rotation of adjustment pin 36.

Similarly, offset circular portion 44 of adjustment pin 36 is disposed within opening 38 of lever stud 32 so that rotational movement of lever 28 will cause rotational movement of offset circular portion 44 within opening 38. Snap ring 46 maintains adjustment pin 36 within opening 34 and in connection with lever 28 and lever stud 32.

Lever stud 32 extends outwardly from opening 34 and through opening 48 in blade 18 and into cavity back 50 of blade 18 where it is secured by adjustment nut 52 that is rotated onto the threaded end 54 of lever stud 32.

A spring 56 is coaxially disposed about lever stud 32 and has one end in engagement with a surface 58 in blade 18 and the other end in engagement with a surface 60 in heel 20. Thus, spring 56 tends to urge disengagement of blade 18 from heel 20.

Figure 3:
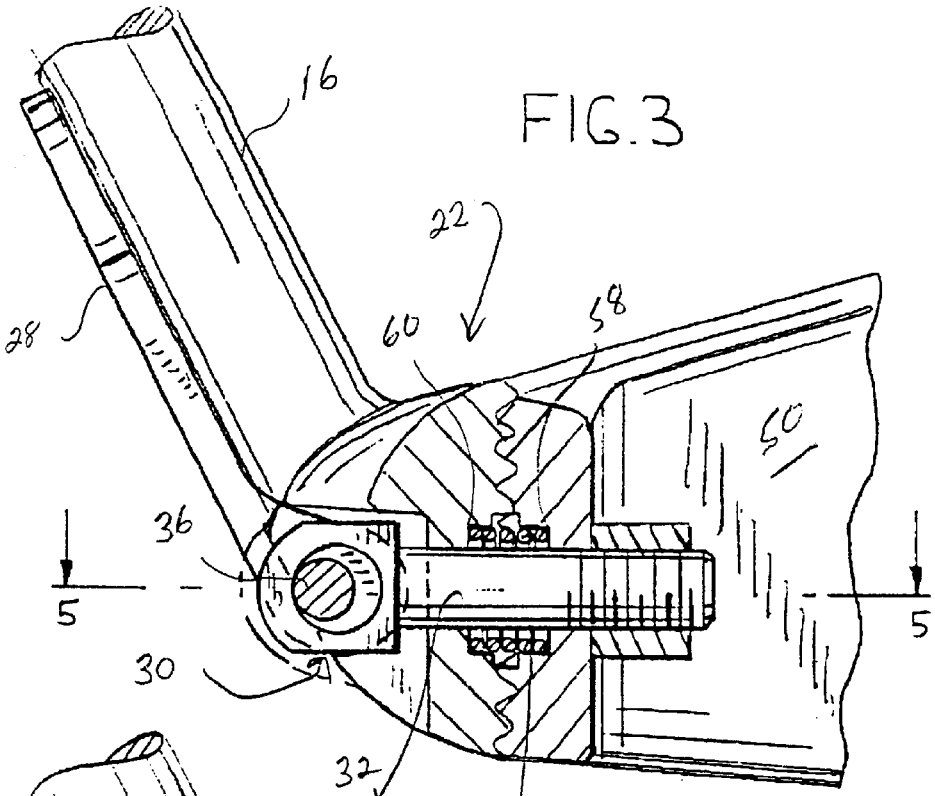
FIG. 3 is an enlarged partial view taken along line 3—3 of FIG. 1.
Figure 4:
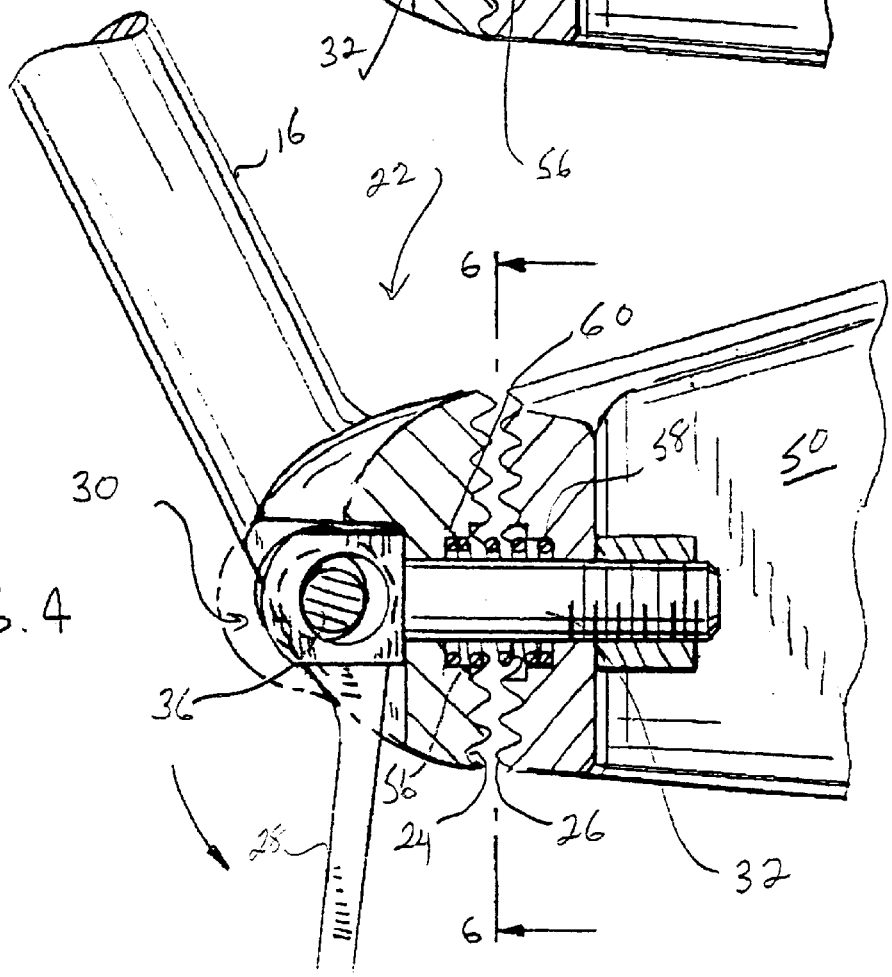
FIG. 4 is a view identical to FIG. 3 but with the head of the club in its rotatable position.
Figure 5:
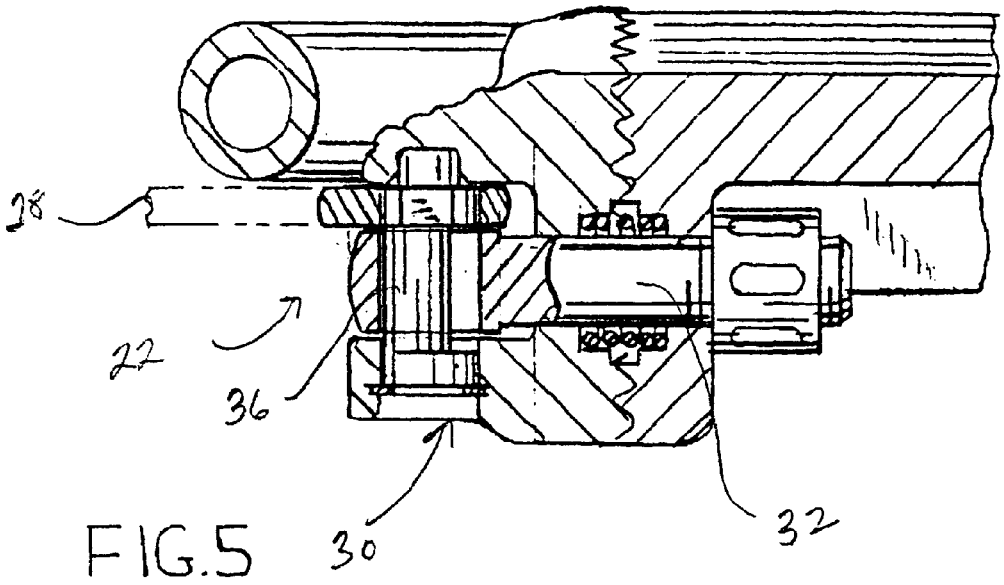
FIG. 5 is a view along the line 5—5 of FIG. 3.
Figure 6:
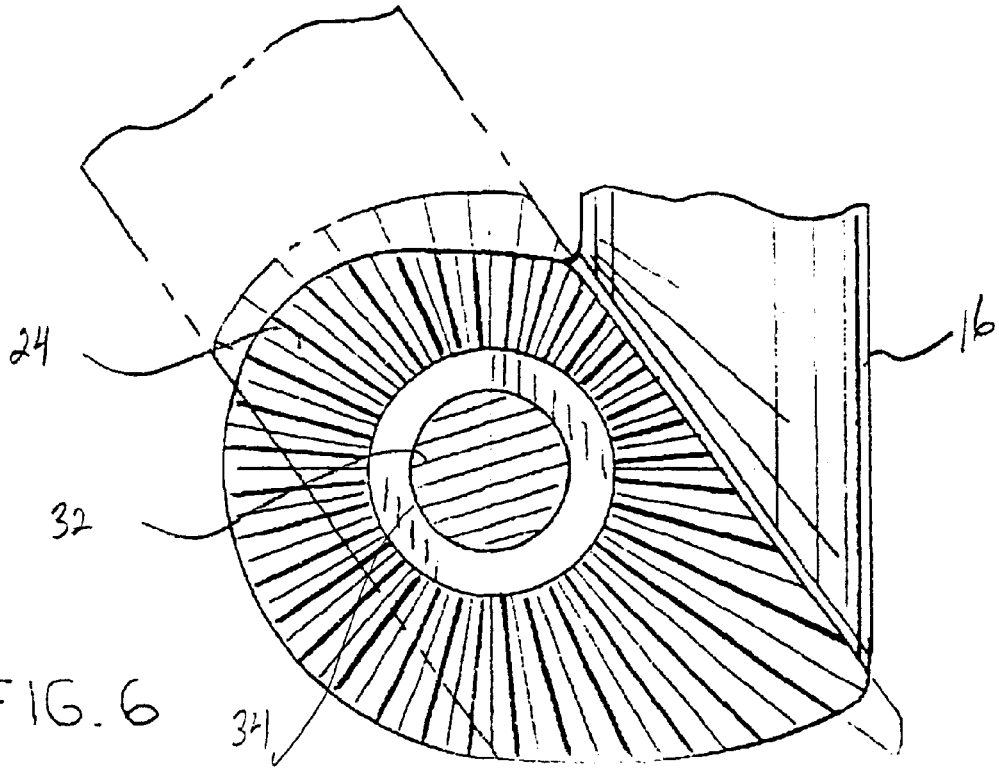
FIG. 6 is a view along the line 6—6 of FIG. 4.
Figure 7:
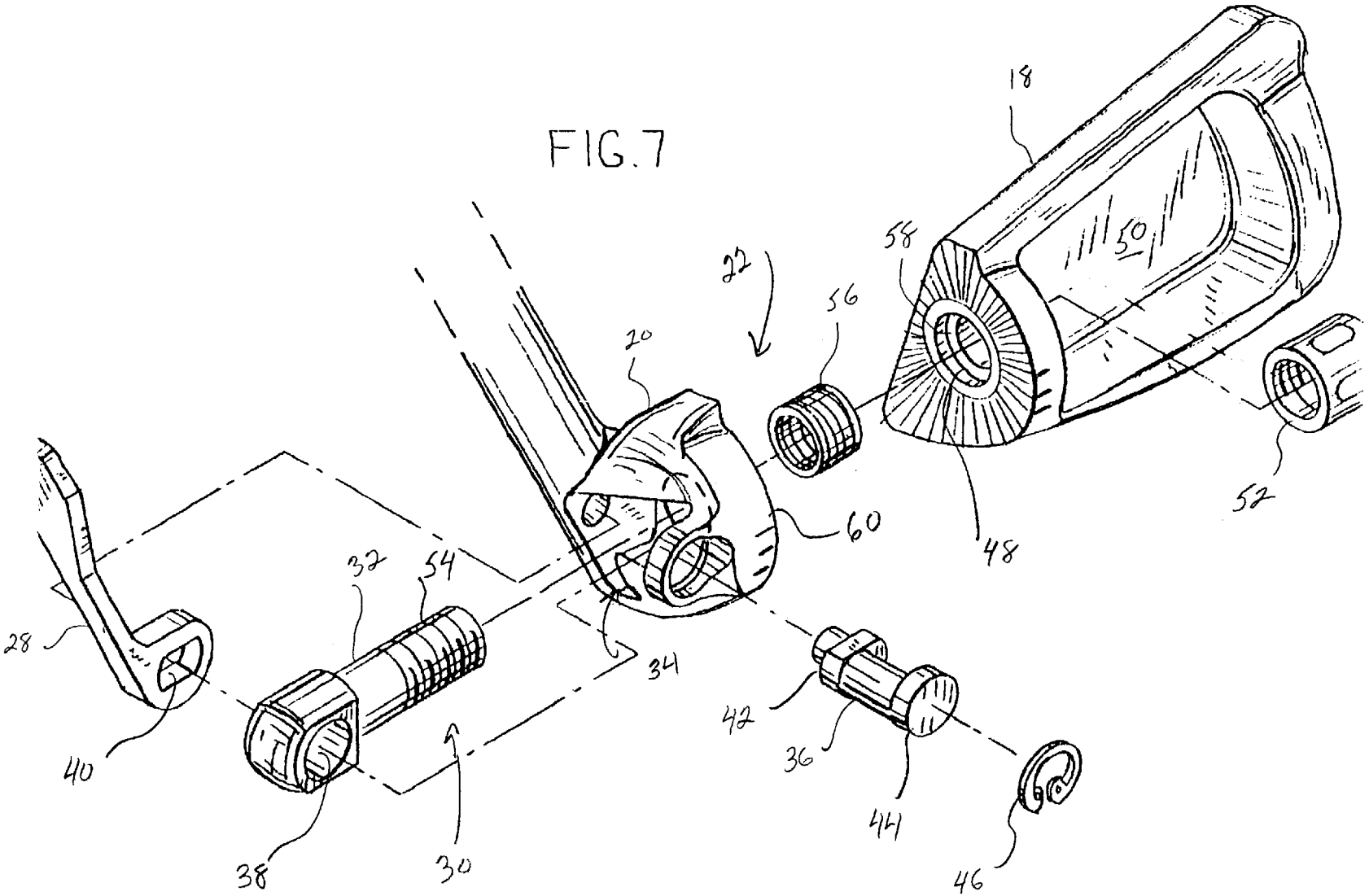
FIG. 7 is an exploded perspective view of a golf club head constructed according to the present invention.

The operation of adjustment assembly 22 is shown on FIGS. 3 and 4. In FIG. 3, lever 28 is disposed substantially parallel to hosel 16 which causes offset circular portion 44 to lock blade 18 to heel 20 and fully compress spring 56. Rotation of blade 18 relative to heel 20 is prevented due to the engagement of mating edges 24 and 26.

When lever 28 is rotated downwardly away from hosel 16, offset circular portion 44 of adjustment in 36 is rotated out of engagement with the surface of opening 38 so as to provide a slight gap so that spring 56 may expand slightly. This movement allows a slight separation between blade 18 and heel 20 so that mating edges 24 and 26 are no longer in engagement. In this position, blade 18 may be rotated relative to heel 20 so as to provide more or less loft, as shown in FIGS. 2A through 2C. Once the loft of blade 18 has been adjusted relative to heel 20, lever 28 is returned to its position substantially parallel to hosel 16 so that spring 56 is again compressed causing engagement of mating edges 24 and 26.

It is recognized that other equivalents, alternatives, and modifications aside from those expressly stated, are possible and within the scope of the appended claims.

I claim:

1. A golf club having a normal address position when the user addresses the ball, said golf club including a shaft, a club head mounted on the lower end of the shaft and including a hosel, a heel portion and a blade portion, said hosel being integrally formed with said heel portion and said blade portion being mounted on said heel portion for limited pivotal movement about an axis which is generally horizontal when the club is in the address position, first coupling means on said heel portion, second coupling means on said blade portion and engageable with said first coupling means for rigidly coupling said blade portion to said heel portion, linkage means coupled to said blade portion and to said heel portion for moving said blade portion between a first position in which said blade is rigidly coupled to said heel and a second position in which said blade is disengaged from said heel to allow rotational movement between said blade and said heel and latching means for selectively positioning said first coupling means in at least said first and second positions so that said blade portion may be pivoted and secured into a plurality of loft angles upon movement into engagement with said heel portion, said latching means comprising a lever pivotally mounted on said hosel and movable between a first position in which said lever is substantially parallel to the hosel and in which said heel portion and blade portion are rigidly coupled and a second position in which said lever is rotated away from the hosel and in which said blade portion is disengaged from said heel portion allowing limited rotational movement of said blade relative to said heel, said linkage means comprises a lever stud disposed within a cavity in said heel portion and extending horizontally from said heel portion into said blade portion and secured thereto, and an adjustment pin operably connected to said lever and said lever stud and movable in cooperation with said lever from a first position in which said heel portion and said blade portion are rigidly coupled to a second position in which said blade portion is disengaged from said heel portion allowing limited rotational movement of said blade relative to said heel, further comprising biasing means coaxially disposed about said lever stud to urge disengagement of said blade portion from said heel portion.

2. A golf club having a normal address position when the user addresses the ball, said golf club including a shaft, a club head mounted on the lower end of the shaft and including a hosel, a heel portion and a blade portion, said hosel being integrally formed with said heel portion and said blade portion being mounted on said heel portion for limited pivotal movement about an axis which is generally horizontal when the club is in the address position, first coupling means on said heel portion, second coupling means on said blade portion and engageable with said first coupling means for rigidly coupling said blade portion to said heel portion, linkage means coupled to said blade portion and to said heel portion for moving said blade portion between a first position in which said blade is rigidly coupled to said heel and a second position in which said blade is disengaged from said heel to allow rotational movement between said blade and said heel and latching means for selectively positioning said first coupling means in at least said first and second positions so that said blade portion may be pivoted into a plurality of loft angles upon movement into and out of engagement with said heel portion, said latching means comprising a lever pivotally mounted on said hosel and movable between a first position in which said lever is substantially parallel to the hosel and in which said heel portion and blade portion are rigidly coupled and a second position in which said lever is rotated away from the hosel and in which said blade portion is disengaged from said heel portion allowing limited rotational movement of said blade relative to said heel, and wherein said linkage means comprises a lever stud disposed within a cavity in said heel portion and extending horizontally from said heel portion into said blade portion and secured thereto, and an adjustment pin operably connected to said lever and said lever stud movable in cooperation with said lever from a first position in which said heel portion and said blade portion are rigidly coupled to a second position in which said blade portion is disengaged from said heel portion allowing limited rotational movement of said blade relative to said heel.

3. The golf club defined in claim 2 further comprising biasing means coaxially disposed about said lever stud to urge disengagement of said blade portion from said heel portion.

4. The golf club defined in claim 2 wherein said blade portion is provided with a cavity back and said lever stud includes a threaded end extending into said cavity and secured therein with a threaded fastener.

* * * * *